US005740563A

United States Patent [19]

Gaddy

[11] Patent Number: 5,740,563

[45] Date of Patent: Apr. 21, 1998

[54] BATH CARE OFFSET SWIVEL CHAIR

[76] Inventor: Victor J. Gaddy, 7436 Nationsford Rd., Charlotte, N.C. 28210

[21] Appl. No.: 721,477

[22] Filed: Sep. 27, 1996

[51] Int. Cl.[6] ..... A47K 3/12

[52] U.S. Cl. ..... 4/579; 4/604; 297/344.21; 297/344.24

[58] Field of Search ..... 4/560.1, 561.1, 4/562.1, 563.1, 571.1, 578.1, 579, 590, 604, 611; 297/344.21, 344.22, 344.24

[56] References Cited

U.S. PATENT DOCUMENTS

| | | | |
|---|---|---|---|
| 1,271,170 | 7/1918 | Jellinek et al. | 297/344.24 |
| 2,052,628 | 9/1936 | Higgins . | |
| 2,514,848 | 7/1950 | Davis | 4/176 |
| 2,813,276 | 11/1957 | Lanza | 4/185 |
| 3,022,518 | 2/1962 | Hayden | 4/562.1 |
| 3,422,466 | 1/1969 | Banoczi | 4/185 |
| 3,835,483 | 9/1974 | Emery | 4/185 |
| 4,150,455 | 4/1979 | Bailey | 4/185 |
| 4,734,944 | 4/1988 | O'Brien | 4/589 |
| 4,939,799 | 7/1990 | Van Hovel | 4/578 |
| 4,941,218 | 7/1990 | McCartney | 4/579 |
| 4,975,991 | 12/1990 | Peterson | 4/571.1 |
| 5,068,930 | 12/1991 | Ruggiero | 4/560 |
| 5,097,542 | 3/1992 | Roesler | 4/579 |

*Primary Examiner*—Henry J. Recla
*Assistant Examiner*—Charles R. Eloshway
*Attorney, Agent, or Firm*—Dougherty & Associates

[57] ABSTRACT

An improved offset swivel bath and shower chair apparatus that can be folded in a manner which makes movement or transport of the device reasonably easy. The apparatus is placed in a bathtub with a shower facility. The device is adjustable to adapt and secure the apparatus to tubs of various widths. An offset swivel mechanism allows an user to bring the chair into a position where the leading edge of the seat extends beyond the edge of the bathtub so that a person of limited mobility can easily lower himself into a seated position at the edge of the bathtub. The offset swivel chair affords an easy rotational arc of the seat into the center of the bathtub.

21 Claims, 2 Drawing Sheets

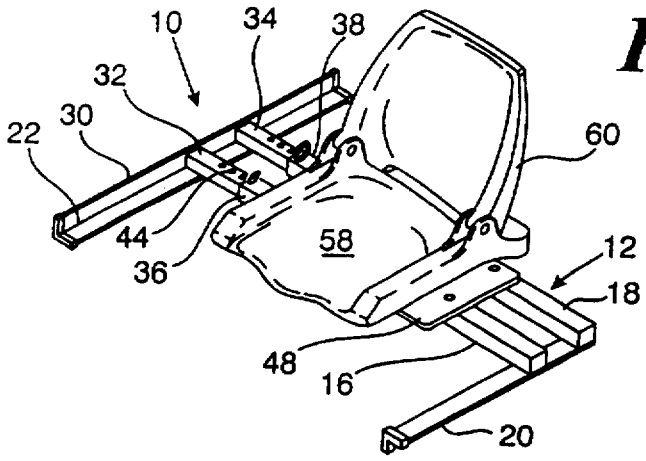
Fig.1
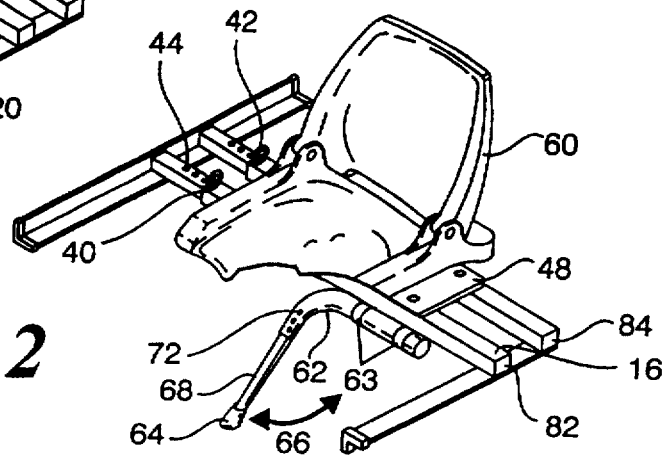
Fig.2
Fig.3
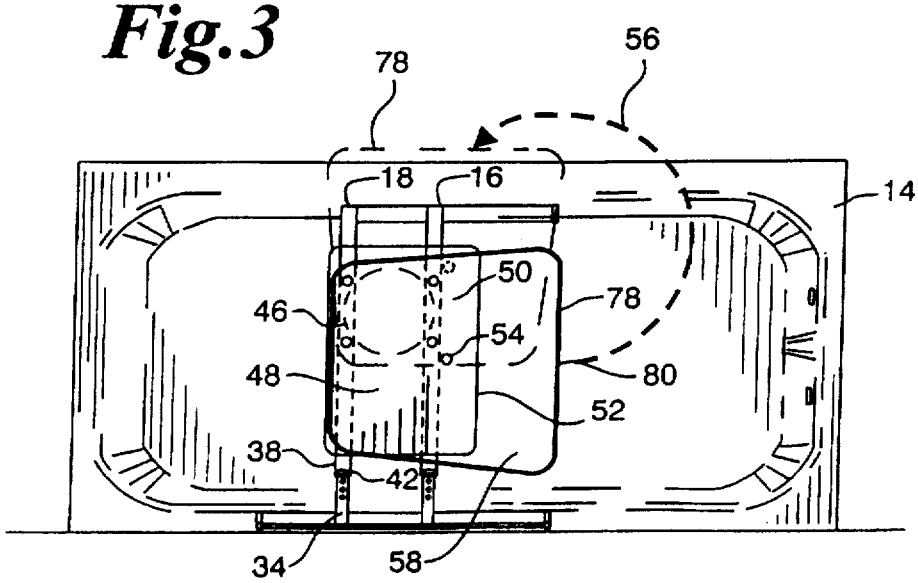

BATH CARE OFFSET SWIVEL CHAIR

FIELD OF THE INVENTION

The present invention relates to an offset swivel bath and shower chair that is easily used by persons of restricted movement or persons who may be prone to fall in a bathing situation. The offset swivel bath chair is securable on a bathtub, and easily permits one of limited mobility to shower while seated on the device.

BACKGROUND OF THE INVENTION

Persons with any type of temporary or permanent disability in their backs, legs, or arms may experience difficulty getting into and out of the bathtub or shower. Such disabilities may arise due to increasing age, a missing limb, blindness, arthritis, broken bones, back trouble, or paralysis. A person with any of these disabilities may experience further injury due to tripping, slipping, or falling in the bathtub.

There exists a strong need for a simple device which will increase the safety of a person with limited mobility by allowing such person to shower while seated. While the prior art recites many different attempted solutions to this problem, many of the devices proposed, while simple, lack the proper safety features which would make them truly effective. Alternative devices suggested by the prior art become so complex that the devices are too bulky and complex to be used effectively in a home setting.

These complex devices also tend to be very costly, thereby putting the devices beyond the financial capabilities of many of the people that have a real need for the apparatus.

In most home settings, bathrooms tend to be shared by family members who need such devices with people who do not need or use such a device. Therefore, providing a device which can be easily installed and removed is desirable. However, such a device should preferably have a seat with a back rest to provide safer use to persons of limited mobility.

DESCRIPTION OF THE PRIOR ART

Applicant is aware of the following U.S. Patents concerning auxiliary bath care seats or chairs.

| U.S. Pat. No. | Inventor | Issue Date | Title |
|---|---|---|---|
| 2,052,628 | Higgins | 09-01-1936 | BATHTUB SEAT |
| 2,813,276 | Lanza | 11-19-1957 | BATHTUB SEAT |
| 3,422,466 | Banoczi | 01-21-1969 | BATHTUB STOOL WITH SAFETY HAND RAIL |
| 4,150,445 | Bailey | 04-24-1979 | SHOWER BATH CHAIR FOR USE IN CONJUNCTION WITH A BATH TUB |
| 4,939,799 | Van Hovel | 07-10-1990 | PORTABLE, TRAVELER'S BATH SEAT |
| 4,941,218 | McCartney | 07-17-1990 | SEAT STRUCTURE FOR EASY ACCESS TO BATHTUBS |
| 5,068,930 | Ruggiero | 12-03-1991 | INVALID'S BATHTUB SEAT |
| 5,097,542 | Roesler | 03-24-1992 | BATHING CHAIR |

While the prior art listed above recites many different attempted solutions to the problem of providing a bathing chair for persons of impaired mobility, many of the bath seats, while simple, lack the proper safety features which would make these devices truly effective. Some of the prior art devices are so complex that they are too bulky, complex and expensive to be used effectively in a home setting.

Bailey, U.S. Pat. No. 4,150,445, teaches a shower assembly having a track to support a chair above a bathtub, and a suspension means for the chair which permits linear movement of the chair, as well as rotary movement to allow a user to enter and exit the bathtub.

McCartney, U.S. Pat. No. 4,941,218, teaches a seat structure for providing easy access to bathtubs. The seat fits horizontally on top of the tub, being mounted on a vertical axis.

SUMMARY OF THE INVENTION

The invention is an offset swivel bath and shower chair apparatus having a seat, preferably with a back rest which is hinged at the bottom corners of the chair back. The chair apparatus is adjustable to bathtubs of varying widths. Uniquely this chair apparatus offsetly pivots to move the user from mostly outside of the tub to inside of the tub.

During normal operation, the device is placed in a bathtub with a shower facility, and more preferably in a tub which has a hand-held shower nozzle. The invented device includes means to adjust the apparatus to tubs of various widths. The offset swivel mechanism allows an user to bring the chair into a position where the leading edge of the chair extends beyond the edge of the bathtub so that a person of limited mobility can easily lower himself into a seated position at the edge of the bathtub. Then the offset swivel chair affords an easy arc of the seat back into the center of the bathtub. A person of limited mobility, after moving the seat to the center of the bathtub, can then close the shower curtain and use the shower provisions to bathe. The offset swivel bath and shower chair can be folded in a manner which makes movement, transport or storage of the device relatively easy.

The swivel mechanism supports the seat base in horizontal orientation, without bending or tilting of the seat by persons weighing up to at least two hundred fifty (250) pounds.

The fact that the present invention incorporates a backrest with a seat and allows positioning at both the edge of a bathtub and in the center of a bathtub, with few mechanical parts and reduced complexity, makes the invented bath and shower chair device both user-friendly and economical to produce.

The invented bath care swivel chair is readily installed on and removed from a bathtub and requires no rail or other device to be installed on or near the tub to facilitate installation.

Since no mounting bracket or external hardware is required for installation, there is no damage to the tub or the surrounding area when the invented device is removed.

OBJECTS OF THE INVENTION

The principal object of the present invention is to provide an improved bath and shower chair apparatus for seating a user generally centrally in a tub.

A further object of the present invention is to provide an improved bath and shower chair apparatus which is both safe and economical.

A further object of this invention is to provide a bath and shower chair which is easy to transport.

A further object of this invention is to provide for a bath and shower chair apparatus in which the seat portion of the device can be aligned with the side of the bathtub so that it is easy to use for a person of impaired mobility.

Another object of the invention is to provide a bath and shower chair apparatus which, when used in a home setting, is not obtrusive and allows family members who are not impaired in mobility to easily set the apparatus to one side and use the shower facilities in a normal manner.

Another object of the invention is to provide a bath and shower chair which can be used by persons of impaired mobility comfortably.

Still another object of the invention is to provide a bath and shower chair which can be used by persons of impaired mobility safely.

BRIEF DESCRIPTION OF THE DRAWINGS

The foregoing and other objects will become more readily apparent by referring to the following detailed description and the appended drawings in which:

FIG. 1 is an isometric view of the invented offset swivel bath and shower chair.

FIG. 2 is an isometric view of an alternative embodiment of the invented offset swivel bath and shower chair, showing an optional load-bearing reinforcement leg.

FIG. 3 is a top view of the invented bath and shower chair of FIG. 1, showing the offset swivel apparatus, as well as the relative position of the seat assembly, both at the side of a bathtub and at the center of the bathtub.

DETAILED DESCRIPTION

Figure 5:
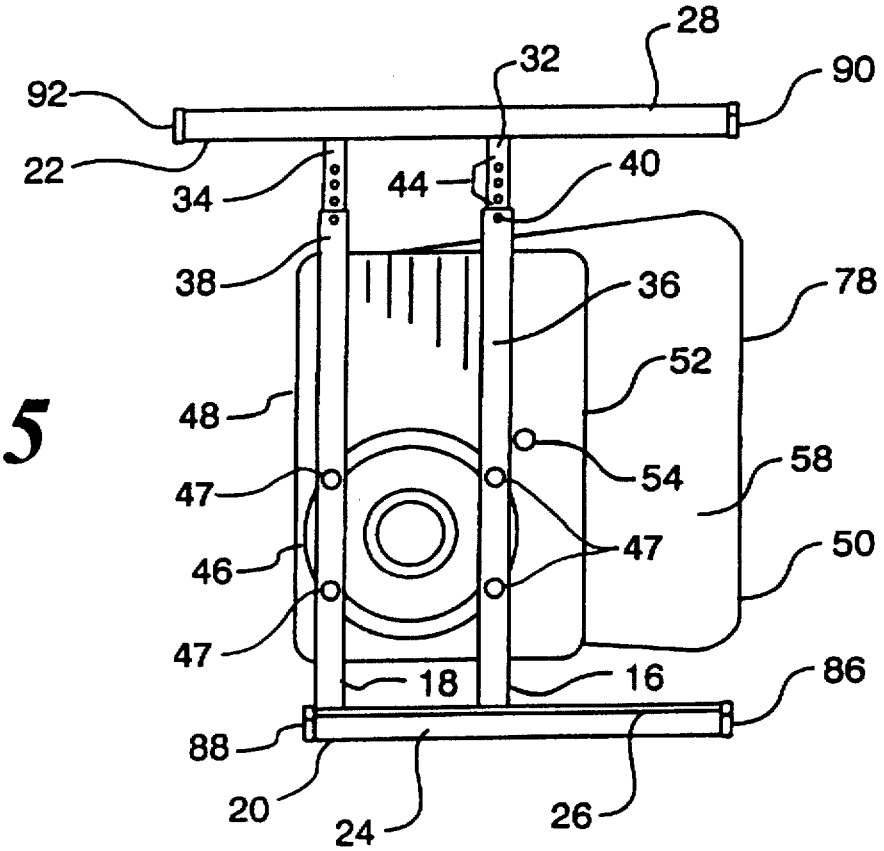
FIG. 5 is a bottom view of the invented bath and shower chair of FIG. 1.

Referring now to the drawings, and particularly to FIG. 1, the invented bath and shower seat assembly 10 includes a support member 12, FIG. 5, for spanning the width of a bathtub 14, FIG. 3. The support means 12 for spanning the width of a bathtub 14 is comprised of two (2) generally parallel adjustable tubular support members 16 and 18. These tubular support members preferably have a square cross section, however they could also be rectangular or round. At the extreme ends, attached to and generally perpendicular to the support members 16 and 18 are generally L-shape tub engaging member 20 and a generally L-shaped wall and tub engaging member 22. The tub engaging member has a top of the tub engagement surface 24 and a tub sidewall engagement surface 26. These surfaces can be coated or rubberized to prevent the marring or scratching of the tub 14. This member 20 is securely affixed to the parallel support members.

The wall and tub engaging member 22 has a tub top engagement surface 28 and a wall engagement surface 30. As with the tub engaging member, the surfaces can be coated or rubberized to prevent marring or scratching and this member 22 is also securely fastened to the support members 16 and 18.

The swivel is generally metal or rigid plastic, has minimal turning friction and is capable of supporting persons up to at least two hundred fifty (250) pounds without sagging, even though the swivel support is not centered.

The support members 16 and 18 are a two (2) piece unit with an inner tubular members 32 and 34 journaled within outer tubular members 36 and 38. A single aperture 40 is provided in each outer tubular member 32 and 34 for placement of a retaining pin 42. The inner tubular members 36 and 38 have multiple apertures 44 which are closely spaced to facilitate adjustment of the unit to a wide variety of tub sizes.

The support members 16 and 18 are directly attached by bolts or screws 47 to a swivel 46 or pivot means which is capable of a 360° rotation. An upper portion of the swivel means is then directly connected to a seat base 48. This seat base 48 is evenly divided into a first zone 50 and second zone 52 which divides the seat base 48 into two (2) equal halves. It is in the first zone 50 that the upper portion of the swivel means 46 is attached to this base member 48. As the pivot is not positioned directly in the center of the seat, the result is an offset pivot which allows for a greater range of motion. The seat base 48 is also fitted with a stop member 54 which extends down from the seat base 48 and is configured to engage the outside of the tubular support means 18 to limit seat rotation to a 90° arc 56. The second side of the seat base 48 is connected to seat member 58. Seat member 58 is affixed to the seat base 48 member 48 so that the center of the seat is substantially aligned with the center of the seat base member. In the preferred embodiment of the apparatus, the seat has a folding back rest 60 which when folded down, helps to reduce the overall bulk of the unit, making the unit easier to transport.

The tubular support members 16 and 18 as well as the tub engaging member 20 and tub and wall engaging member 22 can be made of a wide variety of materials, from fiber glass reinforced plastic materials to metals and alloy materials. Because this unit will be used in a bath setting, it is preferable to use materials which are non-corrosive such as stainless steel, fiber glass reinforced polypropylene or aluminum.

In operation, the offset swivel mechanism (the pivot means 46 for facilitating rotation and associated seat base 48) allows a user to bring the chair into a position where the leading edge 78 extends beyond the edge of the bathtub 14 so that the user can easily lower himself or herself into a seated position at the edge of the bathtub 14. Then the offset swivel chair is easily pivoted through an arc 56, placing the body of the user generally into the center of the bathtub 80. The user, after moving the seat to the center of the bathtub, can then close the shower curtain and use the shower provisions to bathe.

ALTERNATIVE EMBODIMENTS

The bath and shower seat assembly 10 can also be provided with a support leg 62, FIG. 2, pivotally attached through retaining rings 63 to either tubular support members 16 and 18 or to the seat base 48. This support leg 62 increases support and stability of the bath and shower seat assembly 10 when it is used by an individual of greater than average weight. Support leg 62 has a support leg end cap 64 fabricated from a material which will not scratch the interior surface of the tub, such as rubber, neoprene, or a synthetic non-slip material. In operation, the support leg 62 is pivoted outward so that it is substantially perpendicular to support member 16. When in use, this support leg transfers some of the weight exerted on the chair to the floor of bathtub 14, and helps to minimize any bowing of the support members 16 and 18. Without use of the support leg 62, the weight of the user would be transferred to the upper surface of bathtub 14 through L-shape tube engaging member 20 and the L-shape wall engaging member 22. In a transit mode, the support leg 62 is pivoted upwards through arc 66 so that support leg 62 is then substantially parallel to seat base 48. This reduces the overall bulk of the apparatus and facilitates carrying and transfer of the invented bath and shower seat assembly 10.

Support leg 62 can be adjustable to facilitate use with tubs of various depths. In the preferred embodiment an inner support leg 68 having an aperture 70 is positioned to telescope within support leg 62 which also has a plurality of apertures 72. A biasing means 74 having a detente 76 is located within inner support leg 68. Biasing means 74 keeps detente 76 protruding through support leg 62 aperture 70 and inner leg aperture 72. The length of the leg can be varied by pushing detente 76 inward past aperture 70 and aperture 72 so that it can be moved to the next aperture opening. One will readily recognize that a multitude of other adjustment means are possible, including use of a peg or retaining rod with aperture openings on both sides of leg 62 and inner leg 68. Further a threaded or lever style tightening mechanism, like that of a tripod, can be used to provide finer adjustment of the length of leg 62.

Tubular support members 16 and 18 which do not abut tub and wall engaging member 22 can be fitted with end caps 82 and 84. The tub engaging member 20 can be fitted with end caps 86 and 88, and tub and wall engaging member 22 can be fitted with end caps 90 and 92.

Figure 4:
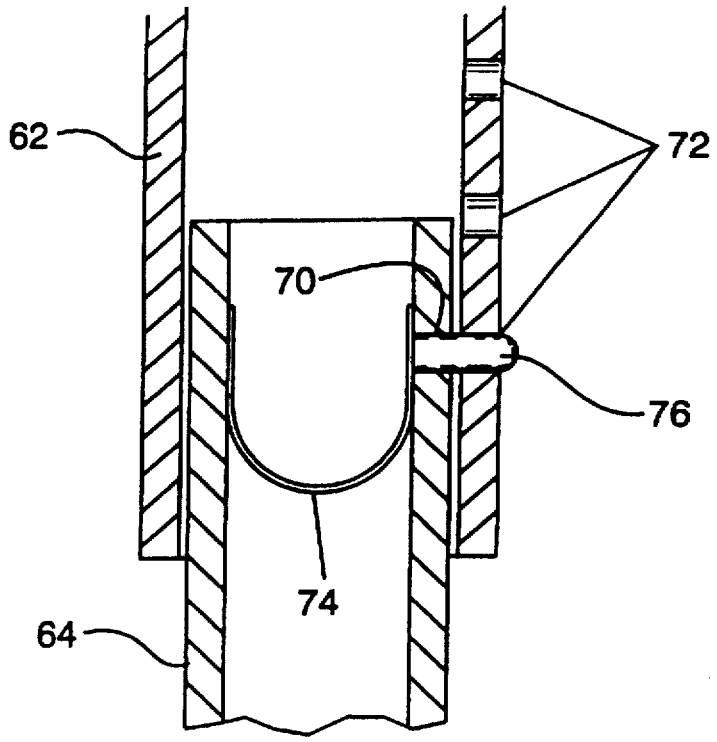
FIG. 4 is a cross sectional view of the adjustment mechanism of the load-bearing leg.

While a retaining pin 42 has been disclosed for the adjustment means for adjusting the relationship of inner tubular members 32 and 34 relative to the outer tubular members 36 and 38, it should be immediately recognizable by one of ordinary skill in the art that this same function could be accomplished by the biasing means 74 and detente 76 as shown in FIG. 4.

SUMMARY OF THE ACHIEVEMENT OF THE OBJECTS OF THE INVENTION

From the foregoing, it is readily apparent that I have invented an improved bath and shower chair apparatus which is both safe and economical. The invented bath and shower chair is portable and easy to transport. The seat portion of the device can be aligned with the side of the bathtub, making it is easy to use by a person of impaired mobility. When used in a home setting, the invention is not obtrusive and allows family members, which are not impaired in mobility, to easily set the apparatus to the side and use the shower facilities in a normal manner. Yet use by persons of impaired mobility is comfortable and safe.

It is to be understood that the foregoing description and specific embodiments are merely illustrative of the best mode of the invention and the principles thereof, and that various modifications and additions may be made to the apparatus by those skilled in the art, without departing from the spirit and scope of this invention, which is therefore understood to be limited only by the scope of the appended claims.

What is claimed is:

1. A bath and shower seat assembly for use in combination with a bath tub, comprising:

a support means for spanning the width of a bath tub and having a first side and a second side, a generally L-shaped tub engaging member having a top of the tub engagement surface and a tub sidewall engagement surface, and a generally L-shaped wall engaging member having a top of the tub engagement surface and a wall engagement surface;

pivot means pivotally attached to said first side of said support means for spanning the width of a bath tub;

a rotatable member having a first section, a second section extending beyond said first section, a first side and a second side, said first side of said first section being attached to said pivot means; and a seat assembly fixed to said second side of both said first section and said second section of said rotatable member;

whereby the seat is effectively mounted for offset rotation.

2. The bath and shower seat assembly according to claim 1, further comprising a stop extending from said first side of said rotatable member for limiting rotation of said seat assembly.

3. The bath and shower seat assembly according to claim 1, said seat assembly further comprising a back rest pivotally connected to said seat assembly.

4. The bath and shower seat assembly according to claim 1, wherein said tub engagement surface and said tub sidewall engagement surface are coated to prevent marring of the tub.

5. The bath and shower seat assembly according to claim 1, wherein said tub engagement surface and said wall engagement surface are coated to prevent marring of the tub.

6. The bath and shower seat assembly according to claim 1, where said support means for spanning the width of a bath tub is adjustable.

7. The bath and shower seat assembly according to claim 6 where said support means for spanning the width of a bath tub further comprises:

a first inner tubular member journaled within a first outer tubular member;

a second inner tubular member journaled within a second outer tubular member;

said first outer tubular member having a single aperture;

said second outer tubular member having a single aperture;

said first inner tubular member having multiple apertures;

said second inner tubular member having multiple apertures;

a first retaining pin journaled between said single aperture of said first outer tubular member and one of said multiple apertures of said first inner tubular member; and a second retaining pin journaled between said single aperture of said second outer tubular member and one of said multiple apertures of said second inner tubular member.

8. The bath and shower seat assembly according to claim 1, further comprising a support leg attachable to said second side of said support means for spanning the width of a bath tub.

9. The bath and shower seat assembly according to claim 8, wherein said support leg is adjustable in length.

10. The bath and shower seat assembly according to claim 9, wherein said support leg comprises:

a support leg pivotally attached to said second side of said support means and having a plurality of apertures;

an inner support leg partially journaled within said support leg and having an aperture positioned within said support leg;

a biasing means engaged within said inner support leg; and a detente fixed to said biasing means journaled through support leg aperture and inner leg aperture;

wherein said biased detente fixes the axial relation of said inner support leg relative to said support leg and allows for sliding axial adjustment.

11. A bath and shower seat assembly for use in combination with a bath tub, comprising:

a) adjustable support means for spanning the width of a bath tub and having a first side and a second side, said support means comprising:

1) a first inner tubular member journaled within a first outer tubular member;

2) a second inner tubular member journaled within a second outer tubular member;

3) said first outer tubular member having a single aperture;

4) said second outer tubular member having a single aperture;

5) said first inner tubular member having multiple apertures;

6) said second inner tubular member having multiple apertures;

7) a first retaining pin journaled between said single aperture of said first outer tubular member and one of said multiple apertures of said first inner tubular member; and 8) a second retaining pin journaled between said single aperture of said second outer tubular member and one of said multiple apertures of said second inner tubular member;

b) pivot means pivotally attached to said first side of said support means for spanning the width of a bath tub;

c) a rotatable member having a first section, a second section extending beyond said first section, a first side and a second side, said first side of said first section being attached to said pivot means; and d) a seat assembly fixed to said second side of both said first section and said second section of said rotatable member;

e) whereby the seat is effectively mounted for offset rotation.

12. The bath and shower seat assembly according to claim 11, further comprising a stop extending from said first side of said rotatable member for limiting rotation of said seat assembly.

13. The bath and shower seat assembly according to claim 11, said seat assembly further comprising a back rest pivotally connected to said seat assembly.

14. The bath and shower seat assembly according to claim 11, wherein said support means for spanning the width of a bath tub further comprises:

a generally L-shaped tub engaging member having a top of the tub engagement surface and a tub sidewall engagement surface; and a generally L-shaped wall engaging member having a top of the tub engagement surface and a wall engagement surface.

15. The bath and shower seat assembly according to claim 14, wherein said tub engagement surface and said wall engagement surface are coated to prevent marring of the tub.

16. The bath and shower seat assembly according to claim 11, further comprising a support leg attachable to said second side of said support means for spanning the width of a bath tub.

17. The bath and shower seat assembly according to claim 16, wherein said support leg is adjustable in length.

18. A bath and shower seat assembly for use in combination with a bath tub, comprising:

a support means for spanning the width of a bath tub and having a first side and a second side:

pivot means pivotally attached to said first side of said support means for spanning the width of a bath tub;

a rotatable member having a first section, a second section extending beyond said first section, a first side and a second side; said first side of said first section being attached to said pivot means; and a seat assembly fixed to said second side of both said first section and said second section of said rotatable member;

an adjustable length support leg attachable to said second side of said support means for spanning the width of a bath tub, comprising:

a support leg pivotally attached to said second side of said support means having a plurality of apertures;

an inner support leg partially journaled within said support leg having an aperture positioned within said support leg;

a biasing means engaged within said inner support leg; and a detent fixed to said biasing means journaled through support leg aperture and inner leg aperture;

wherein said biased detent fixes the axial relation of said inner sport leg relative to said support leg and allows for sliding axial adjustment;

whereby the seat is effectively mounted for offset rotation.

19. The bath and shower seat assembly according to claim 18, further comprising a stop extending from said first side of said rotatable member for limiting rotation of said seat assembly.

20. The bath and shower seat assembly according to claim 18, said seat assembly further comprising a back rest pivotally connected to said seat assembly.

21. The bath and shower seat assembly according to claim 18, where said support means for spanning the width of a bath tub is adjustable.

* * * * *